US006291018B1

(12) United States Patent
Dattilo

(10) Patent No.: US 6,291,018 B1
(45) Date of Patent: Sep. 18, 2001

(54) METHOD FOR APPLYING A COMPOSITE COATING HAVING A POLYCHROMATIC EFFECT ONTO A SUBSTRATE

(75) Inventor: Vincent P. Dattilo, Strongsville, OH (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 09/440,610

(22) Filed: Nov. 15, 1999

(51) Int. Cl.[7] ..... B05D 1/38

(52) U.S. Cl. ..... 427/377; 427/379; 427/388.1; 427/388.4; 427/402; 427/407.1; 427/409; 427/421

(58) Field of Search ..... 427/457, 458, 427/470, 475, 477, 479, 485, 486, 402, 407.1, 409, 421, 377, 379, 388.1, 388.4

(56) References Cited

U.S. PATENT DOCUMENTS

| | | | | |
|---|---|---|---|---|
| 3,979,535 | | 9/1976 | Govindan | 427/422 |
| 4,239,431 | | 12/1980 | Davini | 414/1 |
| 4,342,535 | | 8/1982 | Bartlett et al. | 414/744 A |
| 4,342,536 | | 8/1982 | Akeel et al. | 414/744 A |
| 4,358,026 | | 11/1982 | Mäkinen | 222/1 |
| 4,362,124 | | 12/1982 | Fleig | 118/698 |
| 4,397,422 | | 8/1983 | Gwyn | 239/207 |
| 4,498,414 | | 2/1985 | Kiba et al. | 118/663 |
| 4,521,462 | * | 6/1985 | Smythe | 427/421 |
| 4,532,148 | | 7/1985 | Vecellio | 427/31 |
| 4,539,932 | | 9/1985 | Vecellio | 118/697 |
| 4,552,506 | | 11/1985 | Cummins et al. | 414/735 |
| 4,630,567 | | 12/1986 | Bambousek et al. | 118/323 |
| 4,714,044 | | 12/1987 | Kikuchi et al. | 118/314 |
| 4,721,630 | | 1/1988 | Takeo et al. | 427/421 |
| 4,728,034 | | 3/1988 | Matsumura et al. | 239/212 |
| 4,738,219 | | 4/1988 | Fujisawa | 118/666 |
| 4,771,729 | | 9/1988 | Planert et al. | 118/697 |
| 4,827,993 | | 5/1989 | Ito et al. | 141/83 |
| 4,881,563 | | 11/1989 | Christian | 134/166 |
| 4,902,352 | | 2/1990 | Christian | 134/22.12 |
| 4,928,880 | | 5/1990 | Prus et al. | 239/8 |
| 5,065,695 | | 11/1991 | Baron et al. | 118/688 |
| 5,100,690 | | 3/1992 | Planert et al. | 427/33 |
| 5,130,167 | * | 7/1992 | Mitsuji et al. | 427/407.1 |
| 5,192,609 | | 3/1993 | Carroll, Jr. | 428/328 |
| 5,230,739 | | 7/1993 | Bartow | 118/694 |
| 5,401,790 | * | 3/1995 | Poole et al. | 524/199 |
| 5,554,416 | * | 9/1996 | Scheufler et al. | 427/378 |
| 5,620,750 | | 4/1997 | Minoura et al. | 427/421 |
| 5,718,061 | | 2/1998 | Scheufler et al. | 34/475 |
| 5,871,827 | | 2/1999 | Jaffe et al. | 428/29 |
| 5,879,755 | | 3/1999 | Takahashi et al. | 427/475 |
| 5,916,625 | | 6/1999 | Rosenberger et al. | 427/8 |
| 5,968,268 | | 10/1999 | Kitano et al. | 118/52 |

FOREIGN PATENT DOCUMENTS

| | | |
|---|---|---|
| 3301022 | 7/1984 | (DE) . |
| 34 41 604 A1 | 7/1985 | (DE) . |
| 0038127 | 10/1981 | (EP) . |
| 0122034 | 10/1984 | (EP) . |
| 0338871 | 10/1989 | (EP) . |

(List continued on next page.)

*Primary Examiner*—Shrive P. Beck
*Assistant Examiner*—Jennifer Calcagni
(74) *Attorney, Agent, or Firm*—Deborah M. Altman

(57) ABSTRACT

A method of forming a composite coating having a polychromatic effect over a substrate is provided in which a first liquid basecoat material is exposed to air having a temperature of about 50° F. to about 90° F. (10–32.5° C.), a relative humidity of about 40% to about 80% and an air vilocity of about 20 FPM to about 150 FPM (0.10–0.76 m/s) at the surface of the first basecoat material for a peroid of about 10 to about 180 seconds. A second liquid basecoat material comprising effect pigment is then applied over the set first basecoat material by a bell applicator to produce the composite coating.

26 Claims, 3 Drawing Sheets

FOREIGN PATENT DOCUMENTS

| | | |
|---|---|---|
| 0 589 340 A1 | 3/1994 | (EP) . |
| 0899023 | 3/1999 | (EP) . |
| 2007833 | 5/1979 | (GB) . |
| 2114024 | 8/1983 | (GB) . |
| 56-144763 | 11/1981 | (JP) . |
| 61171527 | 8/1986 | (JP) . |
| 04171068 | 6/1992 | (JP) . |
| 06226154 | 8/1994 | (JP) . |
| 10080649 | 3/1998 | (JP) . |

* cited by examiner

METHOD FOR APPLYING A COMPOSITE COATING HAVING A POLYCHROMATIC EFFECT ONTO A SUBSTRATE

CROSS-REFERENCE TO RELATED APPLICATIONS

This patent application is related to U.S. patent application Ser. No. 09/440,367 entitled "Method and Apparatus for Dynamically Coating a Substrate"; and U.S. patent application Ser. No. 9/439,397 entitled "Method and Apparatus for Applying a Polychromatic Coating onto a Substrate", both of Vincent P. Dattilo and each filed concurrently with the present application, and each of which is herein incorporated by reference.

FIELD OF THE INVENTION

The present invention relates to drying of liquid basecoat and/or clearcoat layers for automotive coating applications and, more particularly, to a multi-step process for applying and drying a first liquid basecoat and/or clearcoat layer before application of a second basecoat and/or clearcoat layer thereon.

BACKGROUND OF THE INVENTION

Today's automobile bodies are treated with multiple layers of coatings which not only enhance the appearance of the automobile, but also provide protection from corrosion, chipping, ultraviolet light, acid rain and other environmental conditions which can deteriorate the coating appearance and underlying car body.

Waterborne coatings are a preferred basecoat and/or clearcoat technology because of their low organic content. The formulations of these coatings can vary widely. However, a major challenge that faces all automotive manufacturers is how to dry, set and/or cure these coatings with minimal capital investment and floor space, which is valued at a premium in manufacturing plants.

The broad use of waterborne coatings in the automotive coating industry has been impeded by a perceived need by automakers for significant investment in environmentally controlled spray booths for coating applications. The use of these environmentally controlled spray booths increases the cost involved in coating the substrate.

A controlled climate during spraying of the waterborne coating has been believed necessary to regulate the evaporation of water and other volatiles as the coating material is sprayed onto the substrate. While controlling the evaporation rate of water is important to the overall performance of the coating in terms of appearance and color, traditional coating processes focus almost exclusively on controlling the water evaporation rate as the waterborne coating material is being sprayed onto the substrate. To that end, expensive environmental controls have been used during the spraying of a coating material onto the substrate to control the evaporation rate at spray. However, the importance of controlling water and/or volatiles evaporation from the deposited waterborne coating material has not been appreciated.

As will be appreciated by one of ordinary skill in the automotive coating art, it would be advantageous to provide a coating method and/or device which reduce or eliminate the need for costly environmentally controlled spray booths for applying a basecoat and/or clearcoat onto an automotive substrate.

SUMMARY OF THE INVENTION

A coating system is provided having at least one first basecoat applicator for applying a first basecoat layer over at least a portion of a surface of a substrate, at least one second basecoat applicator for applying a second basecoat layer over the first basecoat layer, and a first drying chamber located between the first and second basecoat applicators, the interior of the first drying chamber having a temperature of about 50° F. (10.0° C.) to about 90° F. (32.5° C.), a relative humidity of about 40% to about 80% and an air velocity of about 20 FPM (0.10 m/s) to about 150 FPM (0.76 m/s) at the surface of the first basecoat layer.

A method of coating a substrate is provided in which a first liquid basecoat material is applied over the substrate. The first basecoat material is exposed to air having a temperature of about 50° F. (10.0° C.) to about 90° F. (32.5° C.), a relative humidity of about 40% to about 80% and an air velocity of about 20 FPM (0.10 m/s) to about 150 FPM (0.76 m/s) at the surface of the first basecoat material for a period of about 10 to about 180 seconds. A second liquid basecoat material is then applied over the first basecoat material.

A complete understanding of the invention will be obtained from the following description when taken in connection with the accompanying drawing figures wherein like reference characters identify like parts throughout.

DESCRIPTION OF THE PREFERRED EMBODIMENTS

For purposes of the description herein, the term "over" means above but not necessarily adjacent to. Other than in the operating examples, or where otherwise indicated, all numbers expressing quantities of ingredients, reaction conditions, and so forth used in the specification and claims are to be understood as being modified in all instances by the term "about". Also, as used herein, the term "polymer" is meant to refer to oligomers, homopolymers and copolymers.

Figure 1:
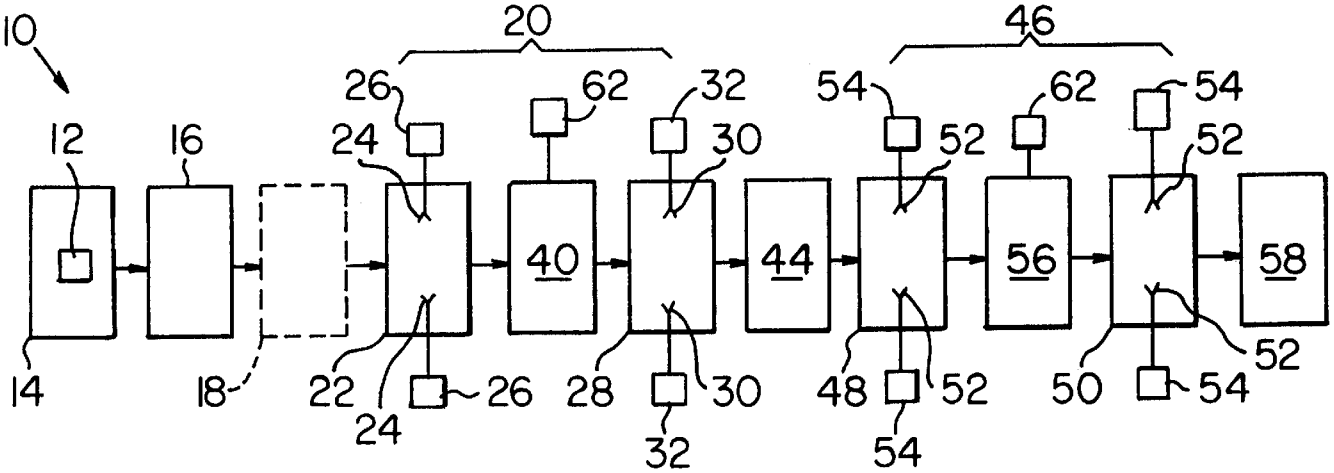
FIG. 1 is a schematic block diagram (not to scale) of a coating system according to the present invention.

FIG. 1 schematically depicts a coating system 10 incorporating features of the invention. This system 10 is suitable for coating metal or polymeric substrates in a batch or continuous method. In a batch method, the substrate is stationary during each treatment step, whereas in a continuous method the substrate is in continuous movement along an assembly line. The present invention will be discussed generally in the context of coating a substrate in a continuous assembly line, although the method is also useful for coating substrates in a batch method.

Useful substrates that can be coated according to the method of the present invention include metal substrates, polymeric substrates, such as thermoset materials and thermoplastic materials, and combinations thereof.

Preferably, the substrates are used as components to fabricate automotive vehicles, including but not limited to automobiles, trucks and tractors. The substrates can have any shape, but are preferably in the form of automotive body components such as bodies (frames), hoods, doors, fenders, bumpers and/or trim for automotive vehicles.

The present invention will be discussed generally in the context of coating a metallic automobile body substrate. One skilled in the art would understand that the methods and devices of the present invention also are useful for coating non-automotive metal and/or polymeric substrates, such as motorcycles, bicycles, appliances, and the like.

With reference to FIG. 1, a metal substrate 12 can be cleaned and degreased and a pretreatment coating, such as CHEMFOS 700® zinc phosphate or BONAZINC® zinc-rich pretreatment (each commercially available from PPG Industries, Inc. of Pittsburgh, Pa.), can be deposited over the surface of the metal substrate 12 at a pretreatment zone 14. Alternatively or additionally, one or more electrodepositable coating compositions (such as POWER PRIME® coating system commercially available from PPG Industries, Inc. of Pittsburgh, Pa.) can be electrodeposited upon at least a portion of the metal substrate 12 at an electrodeposition zone 16. Useful electrodeposition methods and electrodepositable coating compositions include conventional anionic or cationic electrodepositable coating compositions, such as epoxy or polyurethane-based coatings. Suitable electrodepositable coatings are discussed in U.S. Pat. Nos. 4,933,056; 5,530,043; 5,760,107 and 5,820,987, which are incorporated herein by reference.

The coated substrate 12 can be rinsed, heated and cooled and then a primer layer can be applied to the substrate 12 at a primer zone 18 before subsequent rinsing, baking, cooling, sanding and sealing operations. The primer coating composition can be liquid, powder slurry or powder (solid), as desired. The liquid or powder slurry primer coating can be applied to the surface of the substrate 12 by any suitable coating method well known to those skilled in the automotive coating art, for example by dip coating, direct roll coating, reverse roll coating, curtain coating, spray coating, brush coating and combinations thereof. Powder coatings are generally applied by electrostatic deposition. The method and apparatus for applying the primer composition to the substrate 12 is determined in part by the configuration and type of substrate material.

Non-limiting examples of useful primers are disclosed in U.S. Pat. Nos. 4,971,837; 5,492,731 and 5,262,464, which are incorporated herein by reference. The amount of film-forming material in the primer generally ranges from about 37 to about 60 weight percent on a basis of total resin solids weight of the primer coating composition.

In an important aspect of the present invention, the basecoat is applied over the substrate 12 in a multi-step method at a basecoat zone 20 comprising one or more basecoat application stations. For example, a first basecoat station 22 has one or more applicators, e.g., bell applicators 24, in flow communication with a first basecoat material supply 26 which supplies at least one first basecoat material or component to the bell applicator(s) 24. A second basecoat station 28 has one or more applicators, e.g., bell applicators 30, in flow communication with a second basecoat material supply 32 which supplies at least one second basecoat material or component to the bell applicator(s) 30.

As described more fully below, the first basecoat material can be applied, e.g., sprayed, over the substrate 12 by one or more bell applicators 24 at the first basecoat station 22 in one or more spray passes to form a first basecoat layer over the substrate 12 and the second basecoat material can be sprayed over the first basecoat material at the second basecoat station 28 by one or more bell applicators 30 in one or more spray passes to form a second basecoat layer. A composite basecoat of the invention is thus formed by one or more second basecoat layers applied over one or more first basecoat layers. As used herein, the terms "layer" or "layers" refer to general coating regions or areas which can be applied by one or more spray passes but do not necessarily mean that there is a distinct or abrupt interface between adjacent layers, i.e., there can be some migration of components between the first and second basecoat layers.

In a preferred aspect of the present invention, both the first and second basecoat materials are liquid, preferably waterborne, coating materials. As used herein, the term "waterborne" means that the solvent or carrier fluid for the coating material primarily or principally comprises water. The first basecoat material generally comprises a film-forming material or binder, volatile material and is substantially free of effect pigment. Preferably, the first basecoat material comprises a crosslinkable coating composition comprising at least one thermosettable film-forming material, such as acrylics, polyesters (including alkyds), polyurethanes and epoxies, and at least one crosslinking material. Thermoplastic film-forming materials such as polyolefins also can be used. The amount of film-forming material in the liquid basecoat material generally ranges from about 40 to about 97 weight percent on a basis of total weight solids of the basecoat material.

Suitable acrylic polymers include copolymers of one or more of acrylic acid, methacrylic acid and alkyl esters thereof, such as methyl methacrylate, ethyl methacrylate, hydroxyethyl methacrylate, butyl methacrylate, ethyl acrylate, hydroxyethyl acrylate, butyl acrylate and 2-ethylhexyl acrylate, optionally together with one or more other polymerizable ethylenically unsaturated monomers including vinyl aromatic compounds such as styrene and vinyl toluene, nitriles such as acrylontrile and methacrylonitrile, vinyl and vinylidene halides, and vinyl esters such as vinyl acetate. Other suitable acrylics and methods for preparing the same are disclosed in U.S. Pat. No. 5,196,485 at column 11, lines 16–60, which are incorporated herein by reference.

Polyesters and alkyds are other examples of resinous binders useful for preparing the basecoating composition. Such polymers can be prepared in a known manner by condensation of polyhydric alcohols, such as ethylene glycol, propylene glycol, butylene glycol, 1,6-hexylene glycol, neopentyl glycol, trimethylolpropane and pentaerythritol, with polycarboxylic acids such as adipic acid, maleic acid, fumaric acid, phthalic acids, trimellitic acid or drying oil fatty acids.

Polyurethanes also can be used as the resinous binder of the basecoat. Useful polyurethanes include the reaction products of polymeric polyols such as polyester polyols or acrylic polyols with a polyisocyanate, including aromatic diisocyanates such as 4,4'-diphenylmethane diisocyanate, aliphatic diisocyanates such as 1,6-hexamethylene diisocyanate, and cycloaliphatic diisocyanates such as isophorone diisocyanate and 4,4'-methylene-bis(cyclohexyl isocyanate).

Suitable crosslinking materials include aminoplasts, polyisocyanates, polyacids, polyanhydrides and mixtures thereof. Useful aminoplast resins are based on the addition products of formaldehyde, with an amino- or amido-group carrying substance. Condensation products obtained from the reaction of alcohols and formaldehyde with melamine, urea or benzoguanamine are most common. Useful polyisocyanate crosslinking materials include blocked or unblocked polyisocyanates such as those discussed above for preparing the polyurethane. Examples of suitable blocking agents for the polyisocyanates include lower aliphatic alcohols such as methanol, oximes such as methyl ethyl ketoxime and lactams such as caprolactam. The amount of the crosslinking material in the basecoat coating composition generally ranges from about 5 to about 50 weight percent on a basis of total resin solids weight of the basecoat coating composition.

Although the first basecoat material is preferably a waterborne coating material, the first basecoat material also can comprise one or more other volatile materials such as organic solvents and/or amines. Non-limiting examples of useful solvents which can be included in the basecoat material, in addition to any provided by other coating components, include aliphatic solvents such as hexane, naphtha, and mineral spirits; aromatic and/or alkylated aromatic solvents such as toluene, xylene, and SOLVESSO 100; alcohols such as ethyl, methyl, n-propyl, isopropyl, n-butyl, isobutyl and amyl alcohol, and m-pyrol; esters such as ethyl acetate, n-butyl acetate, isobutyl acetate and isobutyl isobutyrate; ketones such as acetone, methyl ethyl ketone, methyl isobutyl ketone, diisobutyl ketone, methyl n-amyl ketone, and isophorone, glycol ethers and glycol ether esters such as ethylene glycol monobutyl ether, diethylene glycol monobutyl ether, ethylene glycol monohexyl ether, propylene glycol monomethyl ether, propylene glycol monopropyl ether, ethylene glycol monobutyl ether acetate, propylene glycol monomethyl ether acetate, and dipropylene glycol monomethyl ether acetate. Useful amines include alkanolamines.

Other additives, such as UV absorbers, rheology control agents or surfactants can be included in the first basecoat material, if desired. Additionally, the first basecoat material can include color (non-effect) pigments or coloring agents to provide the first basecoat material with a desired color. Non-limiting examples of useful color pigments include iron oxides, lead oxides, carbon black, titanium dioxide and colored organic pigments such as phthalocyanines. As discussed above, the first basecoat material is substantially free of effect pigments, such as mica flakes, aluminum flakes, bronze flakes, coated mica, nickel flakes, tin flakes, silver flakes, copper flakes and combinations thereof. As used herein, "substantially free of effect pigment" means that the basecoat material comprises less than about 3% by weight of effect pigment on a basis of total weight of the first basecoat material, more preferably less than about 1% by weight, and most preferably is free of effect pigment.

The solids content of the liquid basecoat material generally ranges from about 15 to about 60 weight percent, and preferably about 20 to about 50 weight percent. In an alternative embodiment, the first basecoat material can be formulated from functional materials, such as primer components, which provide, for example, chip resistance to provide good chip durability and color appearance, possibly eliminating the need for a separate spray-applied primer.

The second basecoat material contains similar components (such as film forming material and crosslinking material) to the first basecoat material but further comprises one or more effect pigments. Non-limiting examples of effect pigments useful in the practice of the invention include mica flakes, aluminum flakes, bronze flakes, coated mica, nickel flakes, tin flakes, silver flakes, copper flakes and combinations thereof. The specific pigment to binder ratio can vary widely so long as it provides the requisite hiding at the desired film thickness and application solids and desired polychromatic effect. The amount of effect pigment in the second basecoat material is that which is sufficient to produce a desired polychromatic effect. Preferably, the amount of effect pigment ranges from about 0.5 to about 40 weight percent on a basis of total weight of the second basecoat material, and more preferably about 3 to about 15 weight percent.

Examples of waterborne basecoat materials suitable for use as first and/or second basecoat materials include those disclosed in U.S. Pat. Nos. 4,403,003; 5,401,790 and 5,071,904, which are incorporated by reference herein. Also, waterborne polyurethanes such as those prepared in accordance with U.S. Pat. No. 4,147,679 can be used as the resinous film former in the basecoat materials, which is incorporated by reference herein. Suitable film formers for organic solvent-based base coats are disclosed in U.S. Pat. No. 4,220,679 at column 2, line 24 through column 4, line 40 and U.S. Pat. No. 5,196,485 at column 11, line 7 through column 13, line 22, which are incorporated by reference herein.

With reference to FIG. 1, the first basecoat material is preferably applied over the substrate 12 at the first basecoat station 22 using one or more bell applicators 24. The first basecoat layer is applied to a thickness of about 5 to about 30 microns, and more preferably about 8 to about 20 microns. If multiple bell applicators 24 are used in the first basecoat station 22, the atomization for each of the bell applicators 24 is controlled as described more fully in co-pending U.S. application Ser. No. 09/439,397, entitled "Method and Apparatus for Applying a Polychromatic Coating onto a Substrate", which has been incorporated by reference herein.

As will be understood by one of ordinary skill in the automotive coating art, bell applicators typically include a body portion or bell having a rotating cup. The bell is connected to a high voltage source to provide an electrostatic field between the bell and the substrate. The electrostatic field shapes the charged, atomized coating material discharged from the bell into a cone-shaped pattern, the shape of which can be varied by shaping air ejected from a shaping air ring on the bell. Non-limiting examples of suitable conventional bell applicators include Eco-Bell or Eco-M Bell applicators commercially available from Behr Systems Inc. of Auburn Hills, Michigan; Meta-Bell applicators commercially available from ABB/Ransburg Japan Limited of Tokyo, Japan; G-1 Bell applicators commercially available from ABB Flexible Automation of Auburn Hills, Mich.; or Sames PPH 605 or 607 applicators commercially available from Sames of Livonia, Mich.; or the like. The structure and operation of bell applicators will be understood by one of ordinary skill in the art and hence will not be discussed in further detail herein.

The first basecoat material can be a premixed, waterborne material substantially free of effect pigment as described above and supplied to the one or more bell applicators 24 in the first basecoat station 22 in conventional manner, e.g., by metering pumps. However, in an important aspect of the invention, the first basecoat material applied over the substrate 12 at the first basecoat station 22 can be dynamically mixed from two or more individual components during the coating method. As used herein, "dynamically mixed" means mixing or blending two or more components to form a mixed or blended material as the components flow toward an applicator, e.g., a bell applicator, during the coating process.

To better understand the dynamic mixing concept of the invention, an exemplary dynamic coating device 86 according to the present invention (shown in FIG. 3) will now be discussed. The coating device 86 comprises a plurality of coating component supplies, such as a first component supply 76 containing a first coating component, a second component supply 80 containing a second coating component and a third coating component supply 88 containing a third coating component, each of which is in flow communication with an applicator conduit 90 via respective coating conduits 92. Transport devices, such as fixed or variable displacement pumps 94, can be used to move one or more selected components through the conduits 90, 92. A mixer 96, e.g., a conventional dynamic flow mixer such as a pipe mixer (part no. 511–353) commercially available from Graco Equipment, Inc. of Minneapolis, Minn., is located in the applicator conduit 90 and at least one applicator, e.g. a bell applicator 98, is located downstream of the mixer 96. A conventional color change apparatus 100 or similar control device, such as a Moduflow Colorchange Stack commercially available from Sames of Livonia, Mich. can be used to control the flow rate of the various coating components received from the supplies 76, 80 and/or 88. While the dynamic mixing concept of the invention is discussed herein with reference to supplying the mixed material to one or more bell applicators, the dynamic mixing process of the present invention is not limited to use with bell applicators but could be used with other applicators, such as reciprocating gun applicators.

For purposes of the present discussion regarding application of the first basecoat layer at the first basecoat station 22, the first, second and third coating component supplies 76, 80 and 88 may each comprise a waterborne coating component substantially free of effect pigment and each preferably of a differing primary color such that the color of the first coating material applied over the substrate 12 can be varied by changing the amounts of the selected coating components supplied to the bell applicator 98. Additional examples of dynamic coating devices of the invention which are also suitable for application of the first and/or second basecoat layers over the substrate 12 are discussed below.

With continued reference to FIG. 1, the first basecoat material can be applied over the substrate at the first basecoat station 22 utilizing a conventional spraybooth having an environmental control system designed to control one or more of the temperature, relative humidity, and/or air flow rate in the spraybooth. However, as discussed below, in the preferred practice of the invention, special temperature or humidity controls generally are not required during the spray application of the first basecoat layer at the first basecoat station 22.

After the first basecoat layer is applied at the first basecoat station 22, the coated substrate 12 preferably enters a first flash chamber 40 in which the air velocity, temperature and humidity are controlled to control evaporation from the deposited first basecoat layer to form a first basecoat layer with sufficient moisture content or "wetness" such that a substantially smooth, substantially level film of substantially uniform thickness is obtained without sagging.

Preferably within about 15 to about 45 seconds after completion of the application of the first basecoat layer, the substrate 12 is positioned at the entrance of the first flash chamber 40 and slowly moved therethrough in assembly-line manner at a rate which promotes the volatilization and stabilization of the first basecoat layer. The rate at which the substrate 12 is moved through the first flash chamber 40 depends in part on the length and configuration of the first flash chamber 40 but the substrate 12 is preferably in the first flash chamber 40 for about 10 to about 180 seconds, preferably about 20 to about 60 seconds. The air is preferably supplied to the first flash chamber 40 by a blower or dryer 62. A non-limiting example of a suitable blower is an ALTIVARR 66 blower commercially available from Square D Corporation. The air is circulated at about 20 FPM (0.10 m/s) to about 150 feet per minute (FPM) (0.76 meters/second) air velocity at the surface of the coating, preferably about 50 FPM (0.25 m/s) to about 80 FPM (0.41 meters/sec) air velocity, and is heated to a temperature of about 50° F. (10.0° C.) to about 90° F. (32.5° C.), preferably about 70° F. (21.1° C.) to about 80° F. (26.7° C.) and more preferably about 75° F. (24.0° C.) and relative humidity of about 40% to about 80%, preferably about 60% to about 70%, and more preferably about 65% relative humidity. The air can be recirculated through the first flash chamber 40 since it is not located in a spray zone and therefore is essentially free of paint particulates. While in the preferred embodiment described above the substrate 12 moves through the flash chamber 40, it is to be understood that the substrate 12 also can be stopped in the flash chamber 40.

Contrary to previous thinking, it is believed that the quality of a deposited coating material is more a function of the atomization method and drying conditions subsequent to spray application than the temperature and humidity within a conventional spray booth during application of the coating. It now has been determined that the evaporation rate from the surface of the applied film can be a significant factor in deposited droplet film knit and coalescence. The coating method of the invention, utilizing a flash chamber 40 of the invention between basecoat layer applications, focuses on temperature and humidity control of the wet droplet applied film rather than on environmental control during the spray process itself, contrary to previous coating methods. Utilizing the flash chamber 40 in accordance with the invention eliminates the need for a conventional environmentally controlled spraybooth at the first basecoat station 22 when applying the first basecoat layer.

The substrate 12 is conveyed from the flash chamber 40 and the second, effect pigment-comprising basecoat layer is applied over the first basecoat layer at the second basecoat station 28 by one or more bell applicators 30, preferably utilizing the atomizer control process described above to maximize atomization and optimize droplet size and wetness. While the second basecoat material can be applied in a conventional spraybooth, in a preferred practice of the invention special temperature or humidity controls generally are not required. The second basecoat material can be a premixed, effect pigment-comprising waterborne coating material as described above. Alternatively the second basecoat material can be dynamically mixed using a coating device similar to the coating device 86 discussed above but in which one or more of the coating components in the coating component supplies 76, 80 or 88 comprise effect pigment or effect-pigmented and/or colored coating components which can be dynamically mixed to form the second basecoat material. The thickness of the second basecoat layer is preferably about 3 to about 15 microns, more preferably about 5 to about 10 microns.

One skilled in the art would understand that multiple layers of the first and/or second basecoat materials can be applied, if desired. Also, alternating layers can be applied. The thickness of the composite basecoat, i.e., the combined thickness of the first and second basecoat layers applied to the substrate 12, can vary based upon such factors as the type of substrate and intended use of the substrate, i.e., the environment in which the substrate is to be placed and the nature of the contacting materials. Generally, the thickness of the overall basecoat ranges from about 10 to about 38 microns, and preferably about 12 to about 30 microns.

Applying the effect pigment-containing second basecoat layer over the first basecoat layer after stabilization of the first basecoat material in the flash chamber 40 has been found to permit the effect pigment in the second basecoat layer to correctly orient to provide the desired polychromatic effect even when using bell applicators for the application of both basecoat layers.

The first basecoat layer can be applied as a full-opaque functional coat or a semi-opaque color pigmented coat. The method of the invention provides a deep, color-rich base to which the metallic second basecoat layer can be applied. In the composite basecoat of the present invention, the effect pigment provided in the second basecoat layer preferably is present only in about the outer 60%, more preferably the outer 40% of the total composite basecoat thickness. This coating procedure thus utilizes less effect pigment than conventional basecoats which use effect pigment throughout the entire basecoat thickness and hence is more economically desirable to automakers.

With continued reference to FIG. 1, although not preferred, after application of the second basecoat layer, the composite basecoat can be flashed in a flash chamber 40 as described above before further processing. However, it is preferred that the composite basecoat formed over the surface of the substrate 12 is dried or cured at a conventional drying station 44 after application of the second basecoat layer. For waterborne basecoats, "dry" means the almost complete absence of water from the composite basecoat. Drying the basecoat enables application of a subsequent protective clearcoat, as described below, such that the quality of the clearcoat will not be adversely affected by further drying of the basecoat. If too much water is present in the basecoat, the subsequently applied clearcoat can crack, bubble or "pop" during drying of the clearcoat as water vapor from the basecoat attempts to pass through the clearcoat.

The drying station 44 can comprise a conventional drying oven or drying apparatus, such as an infrared radiation oven commercially available from BGK-ITW Automotive Group of Minneapolis, Minn. Preferably, the basecoat is dried to form a film which is substantially uncrosslinked, i.e., is not heated to a temperature sufficient to induce significant crosslinking, and there is substantially no chemical reaction between the thermosettable film-forming material and the crosslinking material.

After the basecoat on the substrate 12 has been dried (and cured and/or cooled, if desired) in the drying station 44, a clearcoat is applied over the basecoat at a clearcoat zone 46 comprising at least one clearcoat station, e.g., first and second clearcoat stations 48 and 50, respectively, each having one or more bell applicators 52 in flow communication with a supply 54*a* and 54*b*, respectively, of clearcoat material to apply a composite clearcoat over the dried basecoat. The clearcoat materials in the supplies 54*a* and 54*b* can be different or the same material. A second flash chamber 56 (similar to flash chamber 40) can be positioned between the first and second clearcoat stations 48 and 50 so that the clearcoat material applied at the first clearcoat station 48 can be flashed under similar conditions as described above before application of clearcoat material at the second clearcoat station 50.

The clearcoat can be applied by conventional electrostatic spray equipment such as high speed (e.g., about 30,000–60,000 rpm) rotary bell applicators 52 at a high voltage (about 60,000 to 90,000 volts) to a total thickness of about 40–65 microns in one or more passes. The clearcoat material can be liquid, powder slurry (powder suspended in a liquid) or powder (solid), as desired. Preferably, the clearcoat material is a crosslinkable coating comprising one or more thermosettable film-forming materials and one or more crosslinking materials such as are discussed above. Useful film-forming materials include epoxy-functional film-forming materials, acrylics, polyesters and/or polyurethanes, as well as thermoplastic film-forming materials such as polyolefins can be used. The clearcoat material can include additives such as are discussed above for the basecoat, but preferably not effect pigments. If the clearcoat material is a liquid or powder slurry, volatile material(s) can be included. The clearcoat material may be a "tinted" material, e.g., comprising about 3 to about 5 weight percent of coloring pigment on a basis of the total weight of the clearcoat material.

Preferably, the clearcoat material is a crosslinkable coating comprising at least one thermosettable film-forming material and at least one crosslinking material, although thermoplastic film-forming materials such as polylefins can be used. A non-limiting example of a waterborne clearcoat is disclosed in U.S. Pat. No. 5,098,947 (incorporated by reference herein) and is based on water-soluble acrylic resins. Useful solvent borne clearcoats are disclosed in U.S. Pat. Nos. 5,196,485 and 5,814,410 (incorporated by reference herein) and include epoxy-functional materials and polyacid curing agents. Suitable powder clearcoats are described in U.S. Pat. No. 5,663,240 (incorporated by reference herein) and include epoxy functional acrylic copolymers and polycarboxylic acid crosslinking agents, such as dodecanedioic acid. The amount of the clearcoat material applied to the substrate can vary based upon such factors as the type of substrate and intended use of the substrate, i.e., the environment in which the substrate is to be placed and the nature of the contacting materials.

In a preferred embodiment, the method of the present invention further comprises curing the applied liquid clearcoat material at a drying station 58 after application over the dried basecoat. As used herein, "cure" means that any crosslinkable components of the material are substantially crosslinked. This curing step can be carried out by any conventional drying technique, such as hot air convection drying using a hot air convection oven (such as an automotive radiant wall/convection oven which is commercially available from Durr, Haden or Thermal Engineering Corporation) or, if desired, infrared heating, such that any crosslinkable components of the liquid clearcoat material are crosslinked to such a degree that the automobile industry accepts the coating method as sufficiently complete to transport the coated automobile body without damage to the clearcoat. Generally, the liquid clearcoat material is heated to a temperature of about 120° C. to about 150° C. (184–238° F.) for a period of about 20 to about 40 minutes to cure the liquid clearcoat.

Alternatively, if the basecoat was not cured prior to applying the liquid clearcoat material, both the basecoat and the liquid clearcoat material can be cured together by applying hot air convection and/or infrared heating using conventional apparatus to individually cure both the basecoat and the liquid clearcoat material. To cure the basecoat and the liquid clearcoat material, the substrate 12 is generally heated to a temperature of about 120° C. to about 150° C. (184–238° F.) for a period of about 20 to about 40 minutes.

The thickness of the dried and crosslinked composite clearcoat is generally about 12 to about 125 microns, and preferably about 20 to about 75 microns.

Figure 2:
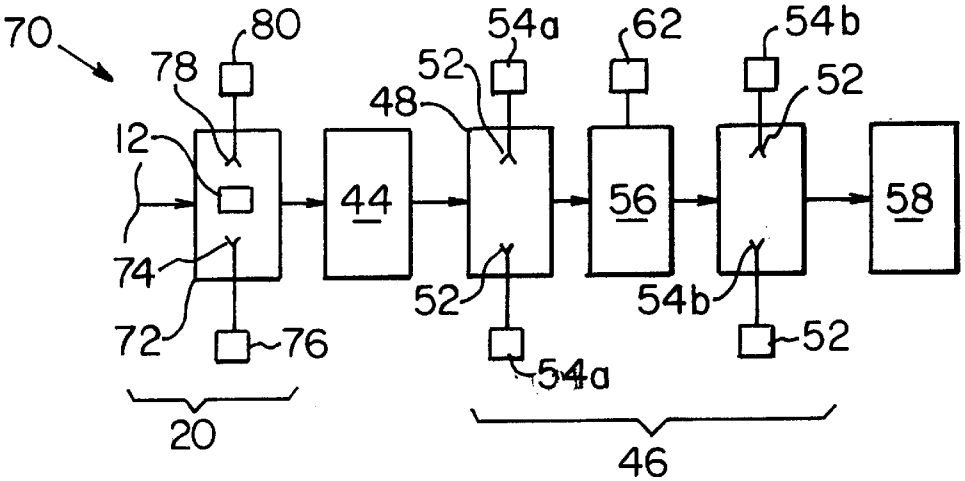
FIG. 2 is a schematic block diagram (not to scale) of an alternative embodiment of a coating system according to the present invention.

An alternative embodiment of a coating system 70 incorporating further aspects of the present invention is shown in FIG. 2. In this system 70, the composite basecoat is applied to the substrate 12 at a single basecoat station 72. Prior to application of the composite basecoat, the substrate 12 can be pretreated, electrocoated and/or primed as described above. The basecoat station 72 can include one or more applicators, for example, one bell applicator 74 can be connected to a supply 76 of first basecoat material, e.g., a waterborne coating material substantially free of effect pigment, and another bell applicator 78 can be connected to a supply 80 of second basecoat material, e.g., a waterborne coating material comprising effect pigment. In this system 70, the bell applicator 74 applies the first basecoat material over the substrate 12 in one or more spray passes to produce a substantially non-effect pigment containing first basecoat layer over the substrate. The first basecoat layer can be flashed, dried or partially dried by the application of heated air over the substrate 12 at the basecoat station 72. The second basecoat material is applied over the first basecoat layer in one or more spray passes by the bell applicator 78 to provide a polychromatic, composite basecoat as described above. The composite basecoat then can be dried in a drying station 44 and clearcoated in a clearcoat zone 46 before curing in a drying station 58, all substantially as described above.

Figure 3:
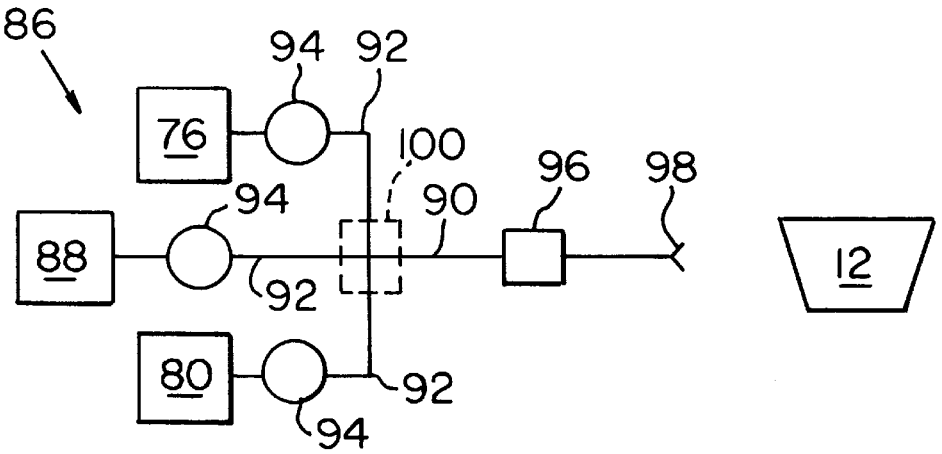
FIG. 3 is a schematic diagram of an exemplary dynamic coating device according to the present invention.

In the modified system 70 described above, separate bell applicators were connected to the first and second basecoat material supplies 76 and 80. However, in the practice of the invention, a single bell applicator could also be used to apply primer, first and second basecoat materials and/or clearcoat over the substrate 12. Any or each of these coating materials can be mixed dynamically before application over the substrate. For example, a selected conventional waterborne color formulation can comprise at least two coating components, a first component having color pigment but which is substantially free of effect pigment and a second, effect-pigmented component. With reference to FIG. 3, these two components, along with a conventional clear blending base, can be contained in the first component supply 76, second component supply 80 and third component supply 88, respectively, of the coating device 86.

Referring to FIG. 3, predetermined amounts of the substantially effect pigment-free first component (in supply 76) and the base (in supply 88) can be pumped through the applicator conduit 90 and dynamically mixed in the mixer 96 to form the first coating material. The first coating material can be applied onto the substrate 12 in one or more spray passes by flow through the bell applicator 98 to form the first basecoat layer. After application of the first basecoat layer, the flow of the first component (in supply 76) can be stopped and the flow of the second component (in supply 80) started to mix the second component and the base material in the mixer 96 to form the effect pigment-containing second basecoat material, which is then sprayed over the first basecoat material in one or more spray passes to form the second basecoat layer.

Figure 4:
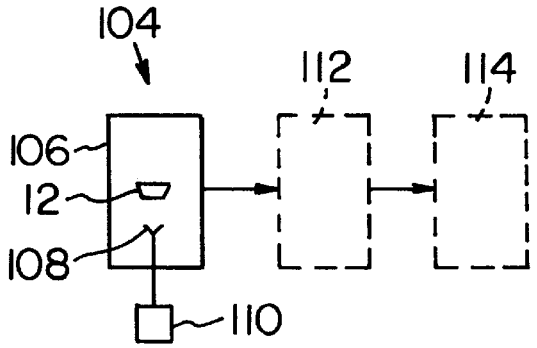
FIG. 4 is a schematic block diagram (not to scale) of an alternative embodiment of a coating system according to the invention.

An alternative embodiment of a coating system 104 incorporating additional features of the invention is shown in FIG. 4. The coating system 104 replaces the basecoat zone 20 and clearcoat zone 46 in FIGS. 1 and 2 with a multi-dynamic coating zone 106. As explained below, in the multi-dynamic coating zone 106 the substrate 12 can be coated with a primer or functional primer (if desired), a basecoat of a selected color and/or effect and a clearcoat by using a single applicator, e.g., bell applicator 108, connected to a dynamic coating system, e.g., coating system 110 shown in FIG. 5 and discussed further below.

Figure 5:
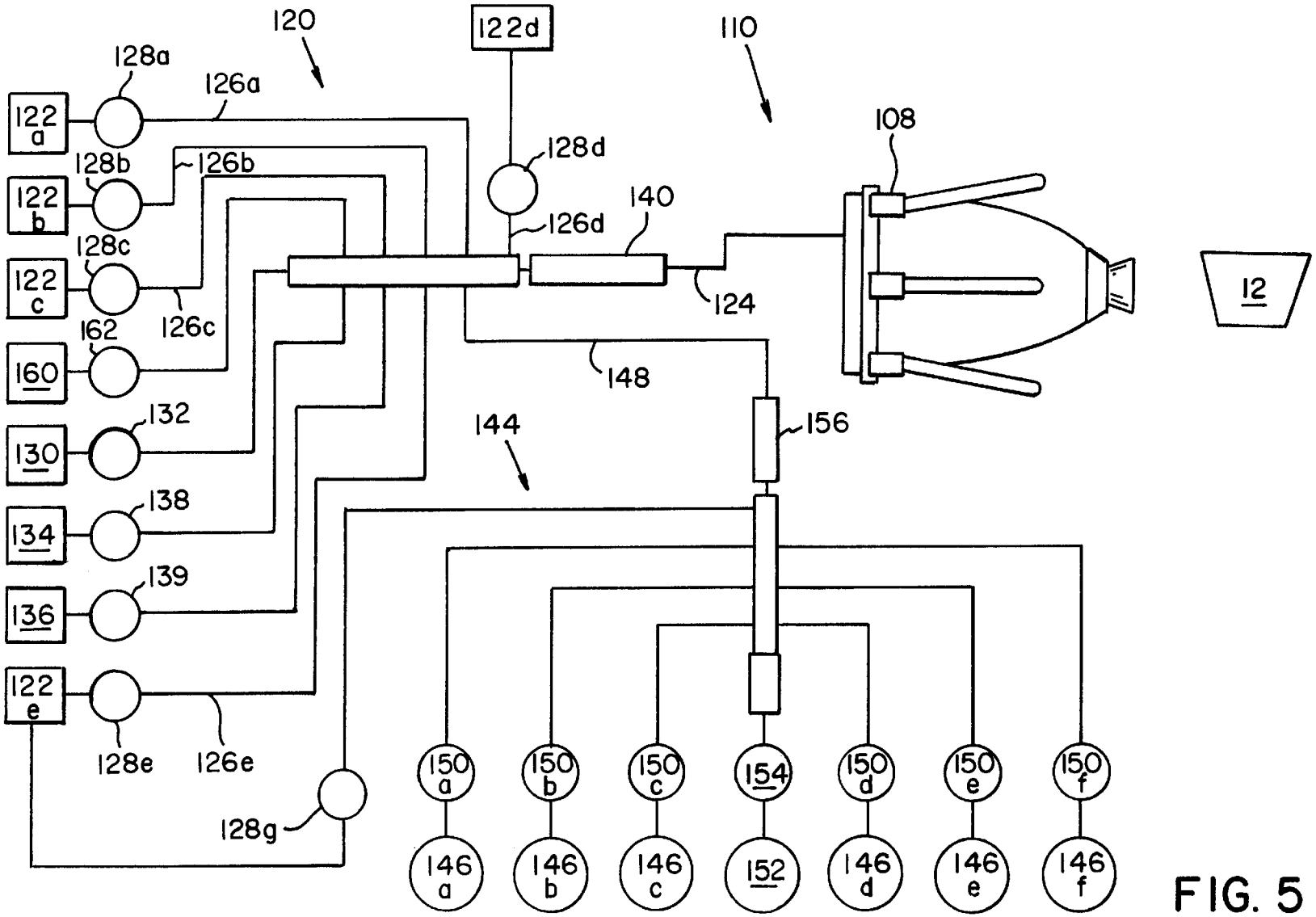
FIG. 5 is a schematic diagram of a dynamic coating device according to the present invention.

With reference to FIG. 5, the dynamic coating system 110 comprises a first dynamic mixing system 120 having a plurality of coating supplies 122*a*–122*e* each containing waterborne, substantially non-effect pigmented coating components preferably of different primary colors, such as red 122*a*, yellow 122*b*, blue 122*c*, white 122*d*, and black 122*e*. A separate coating conduit 126*a*–126*e* is connected between each coating supply 122*a*–122*e* and a conventional transport device, such as pumps 128*a*–128*e*, to transport selected coating components from the individual coating supplies 122*a*–122*e* through a first mixer 140 and a first conduit 124 to an applicator, such as a bell applicator 108. As described more fully below, the first mixer 140 can be used to mix one or more of the coating components from selected coating supplies 122*a*–122*e* and/or a first waterborne base component from a first base supply 130 to form a coating material of a selected color. The pumps 128*a*–128*e* can be fixed, positive displacement or variable displacement pumps, such as 0.6 to 3.0 cc/revolution positive displacement flushable-face gear pumps commercially available from Behr Systems Inc. of Auburn Hills, Mich.

The first base supply 130 is in flow communication with the first conduit 124 through a first base pump 132. Additional coating component supplies, such as a weathering component supply 134 or flexibility component supply 136 can also be in flow communication with the first conduit 124 via pumps 138 and 139, respectively. Examples of suitable flexibility and weathering components include ultraviolet absorbers, hindered amine light stabilizers or antioxidants. Additionally, one or more primer component supplies 160 containing primer component(s) for application onto the substrate prior to basecoating can be in flow communication with the first conduit 24 by a primer pump 162. Examples of suitable primer components are discussed above.

In a preferred embodiment, the dynamic coating system 110 further comprises a second dynamic mixing system 144 which can be in flow communication with the first dynamic mixing system 120. The second dynamic mixing system 144 can include a plurality of different effect pigment component supplies 146*a*–146*f*. For example, supply 146*a* can contain red mica flakes, supply 146*b* can contain blue mica flakes, supply 146*c* can contain green mica flakes, supply 146*d* can contain yellow mica flakes, supply 146*e* can contain coarse aluminum flakes, and supply 146*f* can contain fine aluminum flakes, in flow communication with a second conduit 148 through respective effect pigment pumps 150*a*–150*f*. For example, yellow and blue mica flakes can be mixed to form a green tinted material.

The system 144 can further comprise a second base supply 152 containing a second waterborne base component preferably having a different, preferably lower, viscosity than the first base component. The second base supply 152 is in flow communication with the second conduit 148 via a second base pump 154. An optional second mixer 156 is in flow communication with the second conduit 148 upstream of the position at which the second conduit 148 communicates with the first conduit 124 and can be used to mix one or more of the effect pigment containing components from the supplies 146*a*–146*f* with the second base component before entering the first conduit 124. As shown in FIG. 5, one or more of the first supplies 122, e.g., supply 122*e*, also can be in flow communication with the second conduit 148 by an auxiliary pump 128g to pump one or more selected waterborne coating components directly into the second conduit 148, if desired.

With the dynamic coating system 110, the first basecoat material can be mixed dynamically from one or more of the primary-colored coating components received from the first supplies 122*a*–122*e* to produce a first basecoat material of a desired color. For example, selected individual primary-colored coating components can be pumped from selected first supplies 122*a*–122*e* into the first conduit 124 and dynamically mixed in the first mixer 140 to provide the first basecoat material of a desired color before entering the bell applicator 108 and being sprayed onto the substrate 12 in one or more spray passes to form the first basecoat layer. The amount of each coating component and/or first base component, and hence the final color of the first basecoat material, can be controlled using a conventional electronic or computerized control device (not shown) or proportioning valve system such as an RCS (ratio control system) device commercially available from ITW Ransburg or ITW Finishing Systems of Indianapolis, Indiana; or conventional specialized multiple valve control systems commercially available from Behr Systems Inc. of Auburn Hills, Mich.

After application of the first basecoat layer is complete or nearly complete, selected effect pumps 150*a*–150*f* and the second base pump 154 are started to blend one or more selected effect pigment containing components from selected effect pigment supplies 146*a*–146*f* with the second base component from the second base supply 152. This effect pigment-containing composition can be mixed with selected coating components from the first supplies 122*a*–122*e* in the second mixer 156 and enters the first conduit 124 upstream of the first mixer 140 to produce an effect pigment-containing second basecoat material which is sprayed over the first basecoat material in one or more spray passes to form the second basecoat layer. The effect pigment-containing second basecoat material pushes any remaining first basecoat material out of the first conduit 124 through the bell applicator 108, thus lessening or ameliorating the need for a purging of the bell applicator 108 before application of the second basecoat material. Although in the preferred embodiment described above the mixed second basecoat material passes through the first mixer 140 before entering the bell applicator 108, it should be understood that the second conduit 148 alternatively could be connected directly to the bell applicator 108 such that the mixed second basecoat material would not pass through the first mixer 140 before entering the bell applicator 108. Alternatively, the second mixer 156 can be deleted and all of the components mixed by the first mixer 140.

In the method described above, both the first and second basecoat materials were colored materials, i.e., formed with an amount of a color pigmented coating component from the coating supplies 122*a*–122*e*. However, it should be understood that the second mixing system 144 can be used to apply a transparent or semi-transparent second basecoat layer onto the substrate 12 by pumping clear or tinted basecoat component from the second base supply 152 and selected effect pigment-containing components into the first conduit 124 after application of the first basecoat layer(s).

Figure 6:
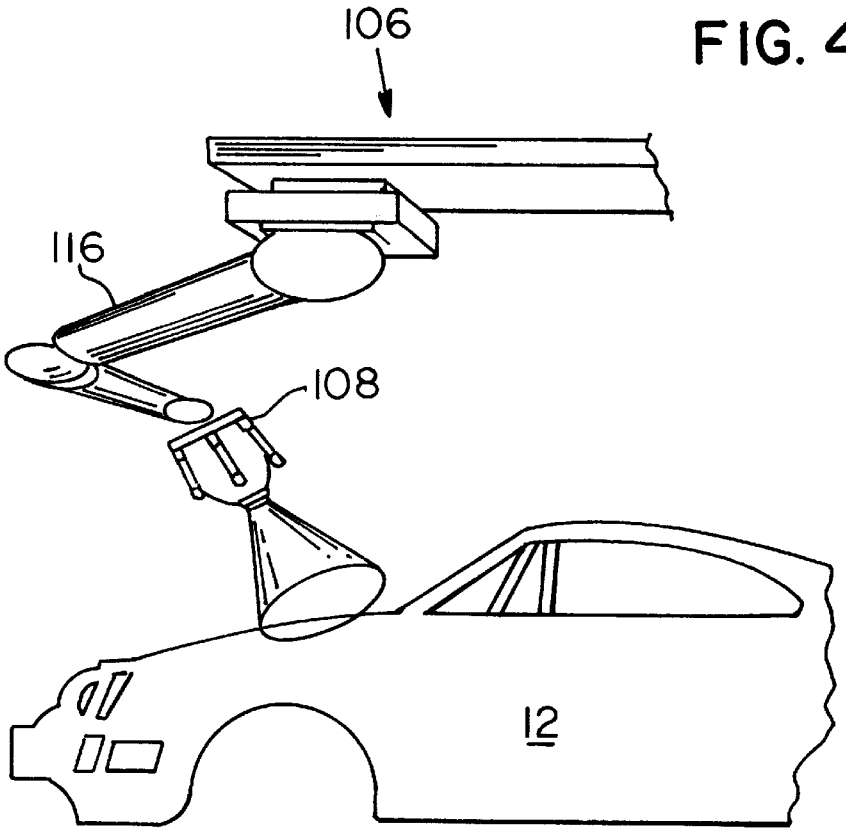
FIG. 6 is a side elevational view of a dynamic coating system according to the present invention.

FIG. 6 is a side elevational view of the multi-dynamic coating zone 106 showing the bell applicator 108 mounted on a movable robot arm 116 to permit the bell applicator 108 to move in x, y and/or z directions to coat all or substantially all of the substrate 12 surface. As will be understood of one of ordinary skill of the automotive coating art, this dynamic coating system 110 can be used to apply a plurality of coating materials, such as functional primers, flexibility coats, weathering coats, clear coats, etc. in series, as desired, onto the substrate 12. Thus, the system 110 could operate to apply substantially all sprayable coatings onto an automotive substrate 12 after an electrodeposition coat or corrosion coat, such as coil-coated BONAZINC, is applied.

For example, with reference to FIGS. 5 and 6, a substrate, such as an electrodeposition coated substrate 12, can be moved into the multi-dynamic coating zone 106 where a functional coating, such as functional primer, can be supplied using the system 110 shown in FIG. 5. The primer component from the primer supply 160 can be pumped by the primer pump 162 into the first conduit 124 and applied by the bell applicator 108 over the substrate. The primer pump 162 can be stopped and selected coating pumps 128*a*–128*e* and the first base pump 132 started to apply the first basecoat material of a selected color over the substrate. The first basecoat material pushes the remaining primer coating material ahead of it as it is mixed in the first mixer 140 and out of the bell applicator 108. The bell applicator 108 can be traversed around the substrate 12 by the robot arm 116 to apply the first basecoat layer onto the substrate 12. The second basecoat material can then be provided by starting the second base pump 154 and selected effect pumps 150*a*–150*f* and optionally stopping or slowing the coating pumps 128*a*–128*e* and/or first base pump 132. The second basecoat material pushes the remaining first basecoat material ahead of it and out of the bell applicator 108.

To apply a clearcoat over the basecoat, the effect pumps 150*a*–150*f* can be stopped and one or both of the first and second base pumps 132 and 154 started. The second base component is preferably of a different, e.g., lower, viscosity than the first base component and can be used as a clearcoat base. The viscosity of the clearcoat, or any of the other coating material supplied by the dynamic coating system 110, can be varied by the addition of different amounts of the two base components to the dynamically blended coating material. It is to be understood that between the applications of the different coating materials in the coating zone 106, the substrate can be flashed, dried or partially dried or cured in the coating zone 106, for example, by the application of heated air.

After the application of the desired coatings, e.g. primer, basecoat(s) and/or clearcoat(s) in the multidynamic coating zone 106, the substrate 12 may optionally be transported through a flash chamber 112 (similar to flash chamber 40 as described above) and/or through a drying station 114 (similar to drying station 44 described above) for final curing.

EXAMPLE 1

In this example, a dynamically mixed coating material is formed according to the present invention.

A steel test panel was coated with commercially available waterborne liquid basecoat and liquid clearcoat materials as described below and was used as a color, appearance, and process "control". The basecoat was applied using a conventional bell/reciprocator gun basecoat process. A clearcoat was applied over the basecoat using a conventional bell application process.

More specifically, the test substrate was an ACT cold rolled steel panel size 10.2 cm by 30.5 cm (4 inch by 12 inch) electrocoated with a cationically electrodepositable primer commercially available from PPG Industries, Inc. of Pittsburgh, Pa. as ED-5000. A waterborne, effect-pigment containing basecoat material (DHWB74101 commercially available from PPG Industries, Inc.) was spray applied in two coating steps. The first basecoat layer was applied by automated bell spray with 60 seconds spraybooth ambient flash and the second basecoat layer was applied by automated gun spray. The composite basecoat film thickness was about 20 microns with a distribution of approximately 60% bell and 40% gun by volume. Spraybooth conditions of 22° C.±2° C. (72° F.±2° F.) and 65%±5% relative humidity were used. Following basecoat application, the basecoated panel was dehydrated using an infrared radiation oven commercially available from BGK-ITW Automotive Group of Minneapolis, Minn. The panel was heated to a peak metal temperature of 41° C.±2° C. (110° F.±2° F.) within three minutes exposure time to infrared radiation. The panel was allowed to cool to ambient condition then clearcoated with liquid DIAMONDCOAT® DCT-5002 coating material (commercially available from PPG Industries, Inc.) and cured for 30 minutes at 141° C. (285° F.) using hot air convection. The overall film thickness, i.e. basecoat and clearcoat, of this "control" panel was approximately 110 to 130 microns.

A first panel coated according to the present invention (Example A) was prepared in a similar manner to the control panel, but with the following exceptions: the commercially available basecoat composition DHWB 74101 was manufactured as three separate coating components. The first component was similar to conventional DHWB 74101 but had all metallic effect pigment (mica flakes and aluminum flakes) removed. The second component was unmodified DHWB 74101 as is commercially available, i.e., containing mica flake and aluminum flake effect pigments. The third component was a non-pigmented clear base component commercially available from PPG Industries, Inc. as HWB 5000. The components were dynamically mixed as described below using a spray device similar to the coating device 86 shown in FIG. 3 and were applied by bell applicator onto the steel test panels.

The first basecoat material was formed by dynamically mixing the first component (DHWB 74101 substantially free of effect pigment) with the third component (HWB 5000) using a commercially available Static-Mixing Tube, available from ITW Automotive Group of Indianapolis, Indiana. The ratio of the first to the third component was about 65%/35% volume percent and was controlled by commercially available manual flow-control valves of needle and seat design. This dynamically blended first basecoat material was applied using a Behr bell atomizer (Behr Eco-Bell and 55 mm Eco-M Style Cup commercially available from Behr Systems Inc., of Auburn Hills, Mich.) to approximately 12 microns thickness on the panel. This first basecoat layer was flashed for 60 seconds at ambient booth conditions.

A layer of second basecoat material consisting of the second component (DHWB 74101) was applied over the first basecoat material at a thickness of approximately 8 microns using the Behr bell atomizer. The basecoated panel was dehydrated, cooled, clearcoated, and baked to full cure in similar manner to the control panel.

A second panel (Example B) was coated using the same dynamic mixing system and coating components as described above for Example A but the second basecoat layer was applied sing a conventional reciprocating gun applicator rather than a bell applicator.

A third panel (Example C) (comparative) was prepared (which was not dynamically mixed) by applying only the control DHWB 74101 effect-pigmented basecoat over the substrate in two layers in a bell/bell application process.

A fourth panel (Example D) was prepared in similar manner to Example A but using a 50%/50% volume ratio of the first and third components which were dynamically blended to form the first basecoat material.

The color and appearance of the coated panels were measured using the following conventional automotive industry tests: Autospect appearance (Gloss+DOI+Orange Peel (OP)=Overall Rating(CO)), and X-Rite Instrumental Color. The Orange Peel rating, Specular Gloss and Distinction of Image ("DOI") were determined by scanning a 9375 square mm sample of panel surface using an Autospect QMS BP surface quality analyzer device that is commercially available from Perceptron of Ann Arbor, Mich. The overall appearance rating was determined by adding 40% of the Orange Peel rating, 20% of the Gloss rating and 40% of the DOI rating. The X-Rite color measure was determined by scanning multiple 2580 square mm areas of the panel using an MA68 five angle color instrument commercially available from X-Rite Instruments, Inc.

Table I provides the measured films, flow rates and Autospect Values for the above panels. As will be understood by one of ordinary skill in the automotive coating art, in Table I the "L" values relate to the lightness or darkness of the tested panels using the control panel as a base reference (i.e., 0 value). Positive numbers indicate that the tested panel was lighter than the control and negative values indicate that the tested panel was darker than the control. The "a" values relate to color based on a red/green scale and the "b" values relate to color based on a yellow/blue scale. The listed film thickness are in mils (microns) and the listed flow rates are in cc/min.

TABLE I

| Test Runs | Gloss | DOI | OP | CO |
|---|---|---|---|---|
| Control | 46.5 | 58.5 | 65.5 | 58.9 |
| Example A | 52.7 | 62.6 | 62 | 60.4 |
| Example B | 46.3 | 57.3 | 49.9 | 52.1 |
| Example C | 43.4 | 55.7 | 62.3 | 55.8 |
| Example D | 54 | 65.8 | 67.8 | 65 |

| | Films | | | | Flow Rates | | | |
|---|---|---|---|---|---|---|---|---|
| | 1st Bell | Recip. | 2nd Bell | Total | 1st Bell | Recip. | 2nd Bell | Total |
| Control | 0.5 (12.7) | 0.25 (6.35) | | 0.75 (19.1) | 140 | 220 | | 360 |
| Example A | 0.45 (11.43) | | 0.35 (8.89) | 0.8 (20.3) | 100 | | 140 | 240 |
| Example B | 0.51 | 0.25 | | 0.76 | 140 | 220 | | 360 |

TABLE I-continued

| | | | | | | | |
|---|---|---|---|---|---|---|---|
| | (12.95) | (6.35) | | (19.3) | | | |
| Example C | 0.52 | | 0.29 | 0.81 | 130 | 140 | 270 |
| | (13.2) | | (7.4) | (20.6) | | | |
| Example D | 0.51 | | 0.31 | 0.82 | 150 | 150 | 300 |
| | (12.95) | | (7.9) | (20.1) | | | |

As shown in Table I, the substrates coated with dynamically blended coatings (Examples A, B and D) according to the present invention demonstrated generally better Autospect appearance values compared to the conventionally coated control panel. Further, comparison of overall film builds and flow rates demonstrate that the dynamic mixing process of the invention utilizing a bell/bell application process can improve relative transfer efficiency as generally lesser flow rate was required to achieve similar film builds.

Table II provides the X-Rite values for the coated panels discussed above at differing angles of observation.

TABLE II

| | Angle | l | a | b | Δl | Δa | Δb |
|---|---|---|---|---|---|---|---|
| Control | 25° | 34.7897 | 43.302 | 16.8694 | | | |
| | 45° | 22.2395 | 35.552 | 18.2556 | | | |
| | 75° | 16.7968 | 31.307 | 18.6413 | | | |
| Example B | 25° | 32.6606 | 41.983 | 16.8072 | −2.1291 | −1.3193 | −0.0622 |
| | 45° | 20.6871 | 33.566 | 17.7494 | −1.5524 | −1.986 | −0.5062 |
| | 75° | 15.9603 | 30.042 | 17.926 | −0.8365 | −1.2655 | −0.7153 |
| Example A | 25° | 33.9612 | 43.174 | 17.1287 | −0.8285 | −0.1282 | 0.2593 |
| | 45° | 22.0118 | 35.633 | 18.1016 | −0.2277 | 0.0801 | −0.154 |
| | 75° | 16.9036 | 31.469 | 18.6956 | 0.1068 | 0.1621 | 0.0543 |
| Example C | 25° | 29.8612 | 42.975 | 16.9268 | −4.9285 | −0.3272 | 0.0574 |
| | 45° | 21.8167 | 34.897 | 18.2786 | −0.4228 | −0.6559 | 0.023 |
| | 75° | 16.5402 | 30.985 | 18.2657 | −0.2566 | −0.3217 | −0.3756 |
| Example D | 25° | 33.5815 | 44.149 | 17.77 | −1.2082 | 0.8465 | 0.9000 |
| | 45° | 21.7508 | 35.09 | 18.163 | −0.4887 | −0.4626 | −0.092 |
| | 75° | 16.5716 | 30.761 | 18.59 | −0.2252 | −0.5466 | −0.0512 |

As shown in Table II, the dynamically mixed coatings, particularly Example A, demonstrate generally acceptable color compared to the "control" panel.

EXAMPLE 2

This Example illustrates the advantages of using the flash chamber of the present invention on the overall coating process.

Steel test panels were coated with commercially available waterborne liquid basecoat and liquid clearcoat materials as described below and were used as the control. The basecoat was applied using a conventional bell/reciprocator gun application process. The clearcoat was applied over the basecoat using a bell applicator process. The test substrate was an ACT cold rolled steel panel size 10.2 cm by 30.5 cm (4 inch by 12 inch) electrocoated with a cationically electrodepositable primer commercially available from PPG Industries, Inc. of Pittsburgh, Pa. as ED-5000.

A waterborne, effect pigment-containing basecoat material (HWBS-28542 for Controls 1 and 3 and DHWB74101 for Control 2, each commercially available from PPG Industries, Inc.) was spray applied in two coating steps. The first basecoat layer was applied by automated bell spray with 60 seconds spraybooth ambient flash and the second basecoat layer was applied by automated gun spray. The composite basecoat film thickness was about 20 microns with a distribution of approximately 60% bell and 40% gun by volume. Spraybooth conditions of 22° C.±2° C. (73° F.±2° F.) and 65%±5% relative humidity were used.

Following basecoat application, the basecoated panels were dehydrated using an infrared radiation oven commercially available from BGK-ITW Automotive Group of Minneapolis, Minn. The panels were heated to a peak metal temperature of 41° C.±2° C. (110° F.±2° F.) within three minutes exposure time to infrared radiation. The panels were allowed to cool to ambient conditions then clearcoated with liquid DIAMONDCOAT® DCT-5002 coating material (commercially available from PPG Industries, Inc.) and cured for 30 minutes at 141° C. (285° F.) using hot air convection. The overall film thickness, i.e. basecoat and clearcoat, of these "control" panels was approximately 110 to 130 microns.

"Experimental" panels 1A, 2A and 3A similar to the controls 1, 2 and 3 were coated using an identical spray process with the following noted exceptions. The spraybooth conditions were adjusted to 29° C.±2° C. (85° F.±2° F.) and either 55%±5% ("dry") (panel 1A) or 40%±5% ("very dry") (panels 2A and 3A) relative humidity as indicated in Table III. Additional test panels 1B, 2B and 3B were coated identically to the panels 1A, 2A and 3A above, with one important exception. The 60-second flash between first and second basecoat layer applications was not performed in the spraybooth but rather was performed in a flash chamber (box) of the present invention in which the following conditions: 22° C.±2° C. (72° F.±2° F.) and 65%±5% relative humidity with a downdraft velocity corresponding to an air velocity at the surface of the coating of less than about 0.4 m/sec were established.

All panels (control and experimental) for each respective basecoat, were measured for color and appearance using the following tests which were discussed above: Autospect appearance, X-Rite instrumental color, and profilometer. The profilometer value was determined by scanning a 2 mm by 2 cm path with a contact probe that is automatically dragged across the cured basecoat surface of the panel and a direct reading of surface smoothness value in micro-inches is provided. The profilometer is commercially available from Taylor-Hobson instruments.

Table III provides the respective measured color and appearance values (Delta L, Delta a and Delta b) for each panel. The profilometer readings are in micro-inches (microns).

TABLE III

| | Autospec | | | | | X-Rite Color | | | | | | | | |
|---|---|---|---|---|---|---|---|---|---|---|---|---|---|---|
| | | | | | | ΔL | | | Δa | | | Δb | | |
| Panel | Gloss | DOI | OP | Overall | Profil | 25 | 45 | 75 | 25 | 45 | 75 | 25 | 45 | 75 |
| HWBS-28542 | | | | | | | | | | | | | | |
| Control 1 | 48.3 | 60.5 | 51 | 53.9 | | | | | | | Control | | | |
| 1A | 41 | 54.4 | 45.2 | 47.8 | | 0.17 | 0.41 | 0.37 | −0.03 | −0.03 | −0.05 | −0.38 | −0.34 | −0.29 |
| 1B | 45.6 | 58.8 | 48 | 51.5 | | 0.41 | 0.51 | 0.14 | −0.03 | −0.06 | −0.10 | −0.44 | −0.38 | −0.40 |
| DHWB-74101 | | | | | | | | | | | | | | |
| Control 2 | 46.1 | 58.8 | 61.1 | 58.1 | 19 (483) | | | | | | Control | | | |
| 2A | 39.3 | 56.1 | 64.7 | 57.9 | 18 (457) | 1.43 | 1.08 | 0.42 | −0.58 | 0.79 | 0.51 | −1.05 | −0.34 | 0.66 |
| 2B | 46.5 | 60.2 | 63.3 | 59.7 | 21 (533) | 0.74 | 0.48 | 0.16 | −0.07 | 0.28 | 0.13 | −0.12 | 0.00 | 0.04 |
| HWBS-28542 | | | | | | | | | | | | | | |
| Control 3 | 38.3 | 56.2 | 61.1 | 56 | 22 (559) | | | | | | Control | | | |
| 3A | 22.2 | 41 | 35.4 | 35.4 | 31 (787) | −0.70 | 0.37 | 0.16 | 0.31 | 0.21 | 0.18 | 1.09 | 0.86 | 0.59 |
| 3B | 34.1 | 55.1 | 59 | 53.9 | 20 (508) | 0.78 | 0.38 | 0.17 | −0.15 | −0.10 | −0.13 | −0.62 | −0.47 | −0.39 |

As shown in Table III, the panels 1A, 2A and 3A, i.e., those flashed within the spraybooth, exhibited generally lower Autospect values, color change and/or X-Rite values than the panels 1B, 2B and 3B formed using the flash chamber of the invention. The panels 1B, 2B and 3B, (those sprayed identical to the "dry or very dry" control but flashed in the flash chamber of the invention), exhibited values which compare favorably with Controls 1, 2 and 3.

The coating and drying process utilizing the flash chamber of the present invention appears to promote improved physical appearance and color even for waterborne basecoat * coatings applied under atypical spraybooth conditions, i.e., a temperature of 22° C.±2° C. (72° F.±2° F.). It is believed that use of the flash chamber of the present invention would also be useful for replacing existing solventborne coating application processes, which traditionally do not have the application latitude necessary for waterborne coating application, with waterborne coatings without the installation of additional spraybooth climate controls. In the process of the invention, installing a lower cost flash chamber between the first and second basecoat applications, or between subsequent clearcoats, can help promote acceptable droplet coalescence to provide a more desirable coating film. The control climate of the flash chamber can be adjusted easily based on the need to increase or decrease the "wetness" or "dryness" of the droplet deposited film to improve overall coatings film properties both in the wet or as cured.

EXAMPLE 3

This Example illustrates the usefulness of the dynamic mixing process of the present invention not only for blending effect-pigmented and substantially non-effect-pigmented components, but also for dynamically blending different colored components to form a coating of a desired color or shade.

Nine steel test panels were coated with commercially available waterborne liquid basecoat and liquid clearcoat materials as described below (controls 1–9). The test substrates were ACT cold rolled steel panels size 25 cm by 25 cm (10 inch by 10 inch) electrocoated with a cationically electrodepositable primer commercially available from PPG Industries, Inc. as ED-5000. The commercial waterborne basecoat was a laboratory blend of two materials (HWB9517 Black & HWB 90394 White) both commercially available from PPG Industries, Inc.) In the laboratory, the basecoats were blended manually in the volumetric ratios shown in Table IV to produce nine different gray basecoat colors.

TABLE IV

| White | White/Gray | | | Gray | | Gray/Black | | Black |
|---|---|---|---|---|---|---|---|---|
| 100% | 95/5% | 85/15% | 75/25% | 50/50% | 25/75% | 15/85% | 5/95% | 100% |

The materials were applied using a Behr Eco-Bell applicator with a 65 mm Eco-M smooth edged cup, all commercially available from Behr Systems Inc., of Auburn Hill, Mich. The color blends were applied by automated bell spray in one coat to a coating film thickness of about 13 microns. Following basecoat application, the basecoated panels were dehydrated in a convection oven such that peak metal temperature of 41° C.±2° C. (110° F.±2° F.) within five minutes within the oven was achieved. The panels were allowed to cool to ambient condition then clearcoated with liquid DIAMONDCOAT® DCT-5002 coating (commercially available from PPG Industries, Inc.) and cured for 30 minutes at 141° C. (285° F.) using hot air convection. The overall film thickness of these "control" panels was approximately 90 to 100 microns.

Nineteen "experimental" test panels (panels E1–E9 and MD1–MD10) were produced, with panels E1–E9 coated using an identical coating application process as described immediately above for control panels 1–9 with the following noted exceptions. A dynamic coating device as described above was used to dynamically blend the black and white coating components to form varying gray shades.

In the spraying of these nine test panels E1–E9, the mixing process was performed dynamically at the atomizer by control programming of the individual metering pumps to provide the blend ratios listed in Table IV. All other spray and drying process parameters were the same as for the control panels 1–9.

The color of each panel was measured using an X-Rite MA68 five angle color instrument commercially available from X-Rite Instruments, Inc. Color measures were determined by scanning multiple 2580 square mm areas of the panels and using lightness/darkness measure (L value) for the 25°, 45°, and 75° angle. Table V shows that the dynamically-mixed coatings for panels E1–E9 compare favorably to the manually blended coatings of controls 1–9. Some color differences were present for extreme dynamic blends (95% to 5% blends), which are most color sensitive.

TABLE V

| Trial | Blend % white/black | Angle | L value | | Blend % white/black | Angle | L value |
|---|---|---|---|---|---|---|---|
| Control 1 | 100% White | 25° | 88.27 | Control 6 | 25% W/75% Blk | 25° | 25.291 |
| | | 45° | 88.14 | | | 45° | 24.727 |
| | | 75° | 88.58 | | | 75° | 26.365 |
| Panel (E1) | 100% White | 25° | 88.48 | Panel (E6) | 25% W/75% Blk | 25° | 26.022 |
| | | 45° | 88.41 | | | 45° | 25.44 |
| | | 75° | 88.87 | | | 75° | 26.951 |
| Control 2 | 95% W/5% Blk | 25° | 71.78 | Control 7 | 15% W/85% Blk | 25° | 17.55 |
| | | 45° | 71.51 | | | 45° | 16.91 |
| | | 75° | 72.36 | | | 75° | 18.63 |
| Panel (E2) | 95% W/5% Blk | 25° | 73.12 | Panel (E7) | 15% W/85% Blk | 25° | 17.669 |
| | | 45° | 73.93 | | | 45° | 16.976 |
| | | 75° | 74.72 | | | 75° | 18.434 |
| Panel (E2) Repeat | 95% W/5% Blk | 25° | 72.90 | Control 8 | 5% W/95% Blk | 25° | 8.189 |
| | | 45° | 72.65 | | | 45° | 7.693 |
| | | 75° | 73.45 | | | 75° | 9.0357 |
| Control 3 | 85% W/15% Blk | 25° | 59.39 | Panel (E8) | 5% W/95% Blk | 25° | 10.874 |
| | | 45° | 59.03 | | | 45° | 10.346 |
| | | 75° | 60.18 | | | 75° | 11.672 |
| Panel (E3) | 85% W/15% Blk | 25° | 61.88 | Panel (E8) Repeat | 5% W/95% Blk | 25° | 9.629 |
| | | 45° | 61.54 | | | 45° | 9.043 |
| | | 75° | 62.61 | | | 75° | 10.349 |
| Control 4 | 75% W/5% Blk | 25° | 51.46 | Control 9 | 100% Black | 25° | 2.1411 |
| | | 45° | 51.04 | | | 45° | 1.9522 |
| | | 75° | 52.39 | | | 75° | 1.9712 |
| Panel (E4) | 75% W/5% Blk | 25° | 51.74 | Panel (E9) | 100% Black | 25° | 1.9643 |
| | | 45° | 51.36 | | | 45° | 1.7794 |
| | | 75° | 52.61 | | | 75° | 1.7419 |
| Control 5 | 50% W/50% Blk | 25° | 40.23 | | | | |
| | | 45° | 39.72 | | | | |
| | | 75° | 41.27 | | | | |
| Panel (E5) | 50% W/50% Blk | 25° | 40.48 | | | | |
| | | 45° | 40.00 | | | | |
| | | 75° | 41.41 | | | | |
| Panel (E5) Repeat | 50% W/50% Blk | 25° | 40.97 | | | | |
| | | 45° | 40.42 | | | | |
| | | 75° | 41.86 | | | | |

To compare conventional manual versus multi-dynamic blending of silver effect-pigmented basecoats, a control (MD control) and ten multi-dynamic silver test panels (MD1–MD10) were prepared. The test substrates were ACT cold rolled steel panels size 25 cm by 25 cm (10 inch by 10 inch) electrocoated with a cationically electrodepositable primer commercially available from PPG Industries, Inc. as ED-5000. As a control (MD control), silver metallic waterborne basecoat (HWB36427 commercially available from PPG Industries, Inc.) was applied using a Behr Eco-Bell applicator with a 65 mm Eco-M smooth edged cup to a total coating film thickness of about 20–22 microns. Following the first basecoat application, a 90-second (in-booth) ambient flash was used followed by the second basecoat layer application. The basecoated panel was dehydrated in a convection oven such that peak metal temperature of 41° C.±2° C. (110° F.±2° F.) was achieved within five minutes in the oven. The panel was allowed to cool to ambient condition, then clearcoated with liquid DIAMONDCOAT® DCT-5002 coating (commercially available from PPG Industries, Inc.) and cured for 30 minutes at 141° C. (285° F.) using hot air convection. The overall film thickness of this MD control panel was approximately 100 to 110 microns.

In a similar manner, ten dynamically-blended silver coated test panels (MD1–10) were coated following the same process as the MD control silver panel with the following noted exceptions. Each dynamic blend silver test panel was a composite basecoat in which the first basecoat layer was a dynamically blended color as described in Table IV above. The second basecoat layer was applied after a 90-second flash as above, and a layer of HWB 36427 (not dynamically blended) was bell applied to one of two film thickness (6 or 10 microns). For each of the ten test panels MD1–10, the first basecoat layer thickness was about 13 microns. For five of the ten panels (MD 1, 3, 5, 7 and 9) the second basecoat layer thickness was about 10 microns, for the other five test panels (MD 2, 4, 6, 8 and 10) the second basecoat layer thickness was about 6 microns. All test panels were dehydrated, clearcoated, and cured as defined for the MD control.

The silver MD control and dynamically blended silver coatings on the test panels MD1–10 were measured for color using an X-Rite MA68 five angle color instrument as described earlier. The (L, a, and b values) measuring color space attributes are shown in Table VI.

The data in Table VI demonstrate that the dynamically blended silver coatings in which the second basecoat layer was about 10 microns thick applied over any combination of dynamic gray-scale first basecoat layer generally produce an acceptable match to the silver "MD control".

For each of the five dynamically blended silver coatings in which the silver second basecoat layer was about 6 microns over a first basecoat layer gray-scale, it was found that the "face" and "flop" brightness and color could be altered by the gray shade of the first basecoat layer (face and flop being defined as viewing angles perpendicular to and 75° specular of the panel surface, respectively). Thus, dynamically blending the first basecoat layer to provide different shades of gray was found to also impact the polychromatic effect of the composite basecoat, which could provide automakers with an additional method of varying the polychromatic coatings they may wish to produce.

TABLE VI

| | Angle | L | ΔL | Δa | Δb | X-Rite | Comments |
|---|---|---|---|---|---|---|---|
| MD Control | 25° | 101.66 | | | | | |
| | 45° | 65.729 | | | | | |
| | 75° | 43.92 | | | | | |
| Dynamic Blend Silvers | | | | | | | |
| MD1 | 25° | 100.72 | −0.94 | −0.055 | −0.3153 | PASS | Acceptable |
| | 45° | 64.563 | −1.166 | −0.039 | −0.0615 | WARN | Color vs. |
| | 75° | 43.754 | −0.166 | −0.0493 | −0.23 | PASS | Control |
| MD2 | 25° | 102.21 | 0.55 | −0.0709 | −0.3536 | PASS | Equal |
| | 45° | 65.285 | −0.444 | −0.1163 | −0.2274 | PASS | Travel - |
| | 75° | 45.506 | 1.586 | −0.2185 | −0.6481 | FAIL | Brighter Face Lighter Flop |
| MD3 | 25° | 99.876 | −1.784 | −0.0373 | −0.2998 | FAIL | Equal |
| | 45° | 64.036 | −1.693 | 0.0584 | −0.0309 | FAIL | Travel - |
| | 75° | 42.899 | −1.021 | 0.0368 | −0.0791 | FAIL | Darker Face Darker Flop |
| MD4 | 25° | 99.369 | −2.291 | 0.0697 | −0.4012 | FAIL | Equal |
| | 45° | 63.586 | −2.143 | −0.0188 | −0.1217 | FAIL | Travel - |
| | 75° | 42.777 | −1.143 | 0.0281 | −0.4238 | FAIL | Darker Face Darker Flop |
| MD5 | 25° | 100.72 | −0.9423 | −0.041 | −0.1664 | PASS | Acceptable |
| | 45° | 65.487 | −0.2412 | 0.0356 | 0.022 | PASS | Color vs. |
| | 75° | 43.578 | −0.3414 | 0.0629 | 0.0547 | PASS | Control |
| MD6 | 25° | 100.03 | −1.63 | 0.0226 | −0.3731 | FAIL | Equal |
| | 45° | 63.115 | −2.6131 | 0.0608 | −0.0814 | FAIL | Travel - |
| | 75° | 41.339 | −2.5808 | 0.1101 | −0.1293 | FAIL | Darker Face Darker Flop |
| MD7 | 25° | 96.974 | −4.6872 | 0.046 | −0.0723 | FAIL | Lesser |
| | 45° | 64.684 | −1.0449 | 0.066 | −0.0164 | FAIL | Travel - |
| | 75° | 44.066 | 0.1468 | 0.0914 | 0.0237 | PASS | Dark Face, Equal Flop |
| MD8 | 25° | 97.545 | −4.1159 | 0.0088 | −0.1745 | FAIL | Lesser |
| | 45° | 63.4 | −2.3281 | 0.0546 | −0.016 | FAIL | Travel - |
| | 75° | 41.808 | −2.1116 | 0.1151 | −0.1329 | FAIL | Dark Face, Dark Flop |
| MD9 | 25° | 100.18 | −1.4813 | 0.0058 | −0.0688 | WARN | Acceptable |
| | 45° | 66.768 | 1.0391 | 0.0466 | 0.0837 | WARN | Color vs. |
| | 75° | 44.884 | 0.9644 | 0.0739 | 0.0888 | WARN | Control |
| MD10 | 25° | 97.715 | −3.9458 | 0.0603 | −0.181 | FAIL | Equal |
| | 45° | 62.762 | −2.9665 | 0.1156 | 0.0744 | FAIL | Travel - |
| | 75° | 40.355 | −3.5648 | 0.191 | 0.3178 | FAIL | Darker Face, Darker Flop |

As discussed further below, the dynamic mixing process of the invention also can help provide a total coating package (first and second basecoat layers) having a higher solids content (total pigment and binder without volatiles) than using a conventional waterborne silver coating material alone, thus reducing the amount of organic volatiles and paint usage compared to conventional automotive painting applications.

Table VII shows the theoretical percent of solids present in three conventional waterborne coating materials, e.g., black, white and silver, each commercially available from PPG Industries, Inc. of Pittsburgh, Pa.

TABLE VII

| Coating System Package | Theoretical Solids (%) |
|---|---|
| Commercial Coatings | |
| HWB90394 (white) | 53.0 |
| HWB9517 (black) | 38.6 |
| HWB36427 (silver) | 40.6 |
| Volumetric Blends + Silver: | |
| 100% white (HWB90394) | 49.0 |
| 100% black (HWB9517) | 39.3 |
| 75% black/25% white | 42.1 |
| 75% white/25% black | 46.9 |
| 50% black/50% white | 44.5 |

For example, a silver coating using only conventional HWB35427 would be expected to have a total solids content of about 40.6%. However, as shown in Table VII, the total solids content for a silver colored coating can be increased by applying a first basecoat layer of white or a dynamic mixture of white and black and then applying the silver coating over the first basecoat layer. It should be noted that the solids content using the black basecoat material alone was less than that for the silver coating alone.

The process of the present invention can provide improved color flexibility and greater total package solids compared to the use of conventional metallic basecoat materials alone. The dynamic mixing process provides the ability to have a large color palette for both solid color and metallic colors using relatively few blending base colors or metallic blending colors. Solids in the total basecoat package also can be increased. A controllable color contrast change can be achieved based on the blend combination of the first basecoat layer solid color and the blend combination and relative film thickness of the second basecoat layer metallic color.

As will be understood from the above discussion, the present invention provides methods and devices for applying a basecoat, such as an effect pigment-containing composite basecoat, over a substrate using one or more applicators, e.g., bell applicators. The present invention also provides dynamic mixing systems for versatile color blending.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A method of forming a composite coating having a polychromatic effect over a substrate, comprising the steps of:

applying a first liquid basecoat material over a surface of the substrate;

exposing the first liquid basecoat material to air having a temperature ranging from 50° F. (10° C.) to 90° F. (32.5° C.), a relative humidity of 40% to 80% and an air velocity at the surface of the first basecoat material of 20 FPM (0.10 m/s) to 150 FPM (0.76 m/s) for a time period of 10 to 180 seconds to set the first basecoat material; and applying a second liquid basecoat material over the set first basecoat material by at least one bell applicator to form a composite coating, the second basecoat material comprising effect pigment such that the composite coating has a polychromatic effect.

2. The method as claimed in 1, claim wherein the substrate is a metal selected from the group consisting of iron, steel, aluminum, zinc, manganese, alloys and combinations thereof.

3. The method as claimed in claim 1, wherein the substrate is an automotive body component.

4. The method as claimed in claim 1, wherein the liquid basecoat materials are waterborne materials.

5. The method as claimed in claim 1, wherein the first basecoat material is substantially free of effect pigment.

6. The method as claimed in claim 1, wherein the first liquid basecoat material is applied by at least one bell applicator.

7. The method as claimed in claim 1, wherein the drying chamber temperature is 75° F. (24.0° C.).

8. The method as claimed in claim 1, wherein the humidity is 65%.

9. The method as claimed in claim 1, wherein the air velocity is 50 FPM (0.25 m/s) to 80 FPM (0.41 m/s).

10. The method as claimed in claim 1, wherein the time period is 20 to 60 seconds.

11. The method as claimed in claim 1, further comprising applying a liquid clearcoat material over the second basecoat material.

12. The method as claimed in claim 11, further comprising curing the basecoat and clearcoat materials after application of the liquid clearcoat material over the basecoat material.

13. The method as claimed in claim 11, wherein the clearcoating step is practiced by:

applying a first clearcoat material over the basecoat material;

exposing the first clearcoat material to air having a temperature ranging from 50° F. (10° C.) to 90° F. (32.5° C.), a relative humidity of 40% to 80% and an air velocity at the surface of the first clearcoat material of 20 FPM (0.10 m/s) to 150 FPM (0.76 m/s) for a period of 10 to 180 seconds; and applying a second liquid clearcoat material over the first liquid clearcoat material.

14. The method as claimed in claim 13, wherein the temperature in the second drying chamber is 70° F. (21.1° C.) to 75° F. (24.0° C.).

15. The method as claimed in claim 13, wherein the humidity in the second drying chamber is 65%.

16. The method as claimed in claim 13, wherein the air velocity in the second drying chamber is 50 FPM (0.25 m/s) to 80 FPM (0.41 m/s).

17. The method as claimed in claim 13, wherein the time period in the second drying chamber is 20 to 60 seconds.

18. The method as claimed in claim 1, wherein the effect pigment is selected from the group consisting of mica flakes, aluminum flakes, bronze flakes, coated mica, nickel flakes, tin flakes, copper flakes, and combinations thereof.

19. The method as claimed in claim 1, including applying the second basecoat material such that the effect pigment is present only in an outer 40 percent of a total thickness of the composite coating.

20. The method as claimed in claim 1, including forming the first basecoat material by dynamically mixing two or more coating components which are substantially free of effect pigments.

21. The method as claimed in claim 20, wherein a color of the first basecoat material is produced by dynamically mixing two or more coating components of different color.

22. The method as claimed in claim 21, including changing the color of the first basecoat material by changing the amounts of the coating components dynamically mixed to form the first basecoat material.

23. The method as claimed in claim 1, including forming the second basecoat material by dynamically mixing two or more coating components, with one or more of the coating components comprising effect pigments.

24. A method of forming a polychromatic coating over a substrate, comprising the steps of:

applying a first liquid basecoat material over at least a portion of a surface of the substrate by at least one bell applicator, the first basecoat material being substantially free of effect pigment;

exposing the first liquid basecoat material to air having a temperature of 70° F.(21.1° C.) to 75° F. (24.0° C.), a relative humidity of 65% and an air velocity at the surface of the first basecoat material of 50 FPM (0.25 m/s) to 80 FPM (0.41 m/s) for a time period of 20 to 60 seconds to set the first basecoat material; and applying a second liquid basecoat material over the set first basecoat material by at least one bell applicator, the second basecoat material comprising effect pigment.

25. A method of forming a polychromatic coating over a substrate, comprising the steps of:

forming a first liquid basecoat material by dynamically mixing two or more first coating components which are substantially free of effect pigments;

applying the first basecoat material over a surface of the substrate by a bell applicator in a first coating station;

transporting the substrate with the first basecoat material from the first coating station into a drying chamber;

exposing the first basecoat material to air having a temperature ranging from 50° F. (10° C.) to 90° F. (32.5° C.), a relative humidity of 40% to 80%, and an air velocity at the surface of the first basecoat material of 20 FPM (0.10 m/s) to 150 FPM (0.76 m/s) for a time period ranging from 10 seconds to 180 seconds to set the first basecoat material;

transporting the substrate with the set first basecoat material from the drying chamber into a second coating station;

forming a second liquid basecoat material by dynamically mixing two or more second coating components, with one or more of the second coating components comprising effect pigments; and applying the second basecoat material over the set first basecoat material by a bell applicator to form a polychromatic coating.

26. The method as claimed in claim 25, wherein two or more of the first coating components are of different color and the method includes changing the color of the first basecoat material by changing the amounts of the first coating components.

* * * * *